US005821678A

United States Patent [19]

Michel

[11] Patent Number: 5,821,678

[45] Date of Patent: Oct. 13, 1998

[54] ELECTRIC INCANDESCENT LAMP HAVING AN IMPROVED FILAMENT SUPPORT

[75] Inventor: Jean-Pierre A. Michel, Ban-St-Martin, France

[73] Assignee: U. S. Philips Corporation, New York, N.Y.

[21] Appl. No.: 707,273

[22] Filed: Sep. 3, 1996

[30] Foreign Application Priority Data

Sep. 4, 1995 [EP] European Pat. Off. ..... 95202371

[51] Int. Cl.[6] ..... H01K 1/18

[52] U.S. Cl. ..... 313/274; 313/273; 313/579

[58] Field of Search ..... 313/274, 271, 313/273, 578, 579

[56] References Cited

U.S. PATENT DOCUMENTS

| | | | |
|---|---|---|---|
| 2,007,927 | 7/1935 | Braselton | 313/274 |
| 3,376,460 | 4/1968 | Jamson | 313/274 |
| 4,626,735 | 12/1986 | Morris et al. | 313/274 |
| 5,140,217 | 8/1992 | Rao et al. | 313/274 |
| 5,146,134 | 9/1992 | Stadler et al. | 313/579 |
| 5,270,609 | 12/1993 | Smith et al. | 313/578 |
| 5,380,230 | 1/1995 | Smith et al. | 445/32 |

FOREIGN PATENT DOCUMENTS

0616359 A1 9/1994 European Pat. Off. .

*Primary Examiner*—Max H. Noori
*Attorney, Agent, or Firm*—F. Brice Faller

[57] ABSTRACT

An electric incandescent lamp has a filament having two incandescent portions interconnected by an intermediate non-lightemitting conductor. The filament is accommodated in a single ended, pinchsealed tubular glass envelope and is supported therein in that the intermediate conductor is embedded in an inner portion of a second pinch seal. The lamp has means to lower the temperature of the intermediate conductor and thereby of the second pinch, if the maximum permissible temperature of the latter would otherwise be exceeded.

9 Claims, 2 Drawing Sheets

ELECTRIC INCANDESCENT LAMP HAVING AN IMPROVED FILAMENT SUPPORT

BACKGROUND OF THE INVENTION

The invention relates to an electric incandescent lamp comprising:

- a tubular sealed glass envelope having a pinch seal through which current conductors extend to the outside;
- a tungsten filament having a first and a second coiled portion accommodated within the envelope, said first and second portions being arranged one laterally of the other and being interconnected by an intermediate non-lightemitting conductor,
- the filament having end conductors which are connected to said current conductors,
- the filament being supported in the envelope by a portion of the envelope touching and keeping fixed said intermediate conductor.

Such an electric incandescent lamp is known from U.S. Pat. No. 5,146,134.

The known lamp is a single-ended lamp, in which the current conductors supplying energy to the filament during operation pass through the same seal of the envelope. In most events, however, the filament is not rigid enough to remain unsupported between its end conductors and nevertheless not to touch or even to approach the envelope wall too closely. Therefore, the filament is supported by opposed indents in the envelope engaging the intermediate conductor.

Such indents in an envelope which is wide enough to accommodate two filament portions one aside of the other, have the disadvantage that they have to be rather deep and as a result occupy a rather large surface area of the envelope, thereby deflecting the light generated by the lamp. Also, it is rather difficult and time consuming to make these indents, which, moreover, must be at the right place to trap the intermediate conductor.

As an alternative, the said U.S. Patent describes a lamp in which the intermediate conductor is held by a rigid support which extends into the said pinch seal, by which it is anchored. This construction requires, however, an additional component part and, moreover, an additional tool acting during the manufacture of the lamp via the exhaust tube opposite to the said pinch seal to position the support.

From U.S. Pat. No. 5,380,230 a single ended incandescent lamp of the kind described in the opening paragraph is known, in which the intermediate conductor is rigid and has a loop which is kept locked in an tipped off exhaust tube opposite to the pinch seal. This lamp too requires a tool to position said conductor in the exhaust tube.

U.S. Pat. No. 5,565,743 describes an incandescent lamp in which filament portions extend in line and are interconnected by an intermediate conductor which is held by opposed indents. The intermediate conductor is enveloped with a sleeve to reduce its power consumption and to lower its temperature during operation to a value which can be sustained by the envelope.

U.S. Pat. No. 5,140,217 discloses a tubular incandescent lamp in which the end conductors are pieces of hooked tungsten wire, which are inserted into the coiled filament and hook behind end turns thereof.

SUMMARY OF THE INVENTION

It is an object of the invention to provide an electric incandescent lamp of the kind described in the opening paragraph which is of a simple construction which can readily be obtained.

According to the invention this object is achieved in that in that the envelope has a second pinch seal opposite to the pinch seal through which the current conductors extend, in an inner longitudinal portion of which second pinch seal the intermediate conductor is embedded and thereby kept fixed.

The lamp of the invention has several advantages. The lamp is of a simple and reliable construction, and is easily achieved. The tube from which the envelope is made, needs not to be domed down to a narrow diameter to become fused to an exhaust tube at its end opposite to the end which will be closed by the pinch seal containing the current conductors. Because of the width of the second pinch seal, the intermediate conductor can easily be caught when the pinch seal is made. When later on the other pinch seal enveloping the current conductors is made, mechanical tension can easily applied to the filament portions, if so desired.

The filament end conductors and the intermediate conductor may be integral with the coiled portions. They may be constituted by single-coiled tungsten wire in the case the filament portions consist of coiled-coil tungsten wire, or of uncoiled tungsten wire in the case the filament portions are of single-coiled wire. A rod, e.g. of tungsten, may be present in single-coiled end conductors for better weldability to the current conductors. When the intermediate conductor and/or the end conductors are not integral with the coiled filament portions, they may be assembled e.g. by welding, or by screwing them into or onto the coiled portions, or by hooking them into those portions. Wire of refractory metals, such as molybdenum or tantalum, but preferably tungsten, may be used in that event.

The intermediate conductor consumes less power per unit of length and has a lower temperature than the filament portions. Thereby, the conductor does not or does not substantially emit light, and may be in contact with the envelope without causing damage. In the case the lamp is able to consume a relatively high power of about 100 W or more, the maximum permissable temperature, about 900° C. in the case of quartz glass and lower in the case of hard glass in accordance with the properties of the particular kind of glass, may be exceeded. The actual permissible temperature will be clear to those skilled in the art from the properties of the glass. However, the temperature of a pinch seal may be kept low enough by an increased distance of the incandescent portions of the filament and the pinch seal.

The lamp may have means to lower the heat dissipation by the intermediate conductor, if a relatively short length of the lamp is desired and the maximum permissable temperature of the second pinch seal would otherwise be exceeded. To that end the intermediate conductor may be shunted at least over a portion of the length thereof, which is embedded in the second seal. A core rod may be present in the conductor, e.g. a winding mandrel. Such a rod short-circuits windings of the intermediate conductor and provides a low resistance. It is cumbersome, however, to maintain part of the winding mandrel as a core rod or to introduce a rod in the intermediate conductor, in between the coiled filament portions without risking their deformation.

It is preferred to provide a refractory metal sleeve, e.g. a tungsten sleeve over the intermediate conductor. The sleeve may be a foil or a wire wrapped around the conductor. In the case of an integral filament having coiled-coil portions, the intermediate conductor may have three overlaying layers of turns of tungsten wire. To that end during manufacturing the filament, the wire is coiled backwards onto turns already made, and subsequently coiled in the original direction again. The pitch of the turns of these layers, however, need not be the same. For example, the pitch in the intermediate layer could be relatively large.

In a favourable alternative, however, liquid tungsten, obtained by means of e.g. a laser, is deposited in the intermediate conductor.

In lamps having such means to lower the temperature of the intermediate conductor, said conductor may, apart from said means, be identical to the coiled portions of the filament.

Another means to short-circuit at least a portion of the intermediate conductor is a metal foil welded to the intermediate conductor and embedded in the second seal. Apart from short-circuiting the intermediate conductor, said foil acts as a heat-sink, too, because it has a relative large surface area which is in intimate contact with the glass of the seal.

In a variation of this embodiment the foil extends up to an outer surface of the second seal or a metal rod is welded to said foil which extends up to an outer surface.

This variation may be the result of a method to manufacture an electric incandescent lamp in which a lamp is produced in which a metal foil, or a metal rod attached to a metal foil, extended to outside the second seal of the lamp and in which the extending portion thereof was cut off after completion of the second seal.

This variation allows for a simplified production of the lamp as the filament can be held and positioned prior to and during the manufacture of the second seal by holding said extending portion fixed.

The kind of shunt required to comply with the maximum permissible temperature in a certain type of lamp can be established in a few trials without undue experimentation. In lamps having coiled-coil filament portions and consuming a power of about 300 W, a sleeve of e.g. tungsten having a thickness of about 50 $\mu$m proved to suffice in a quartz glass envelope in an event in which the temperature of the second pinch seal otherwise exceeded 900° C.

The electric lamp may have a filling containing, apart from inert gas, a halogen or a halogen-containing compound, like hydrogen bromide. The lamp may consume a relatively high power of, e.g., up to 2 kW or more.

The lamp may be designed for use at mains voltage, e.g. 110 V or 230–240 V. The tubular envelope may have a bulbous shape in between the pinch seals, e.g. for lowering its temperature in the area of the coiled filament portions.

BRIEF DESCRIPTION THE DRAWINGS

Embodiments of the electric incandescent lamp according to the invention are shown in the drawing in which.

DESCRIPTION OF THE PREFERRED EMBODIMENTS

Figure 1:
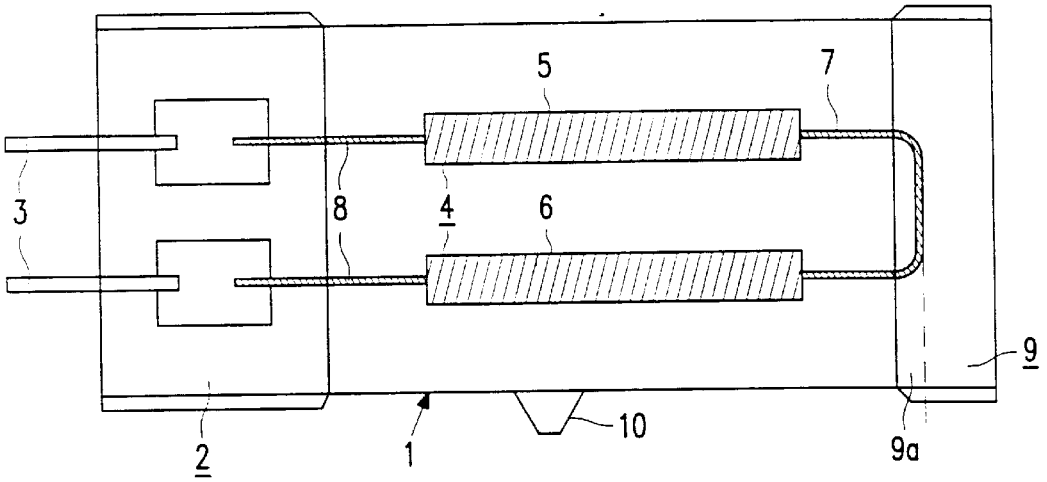
FIG. 1 shows a lamp in side elevation.
Figure 2:
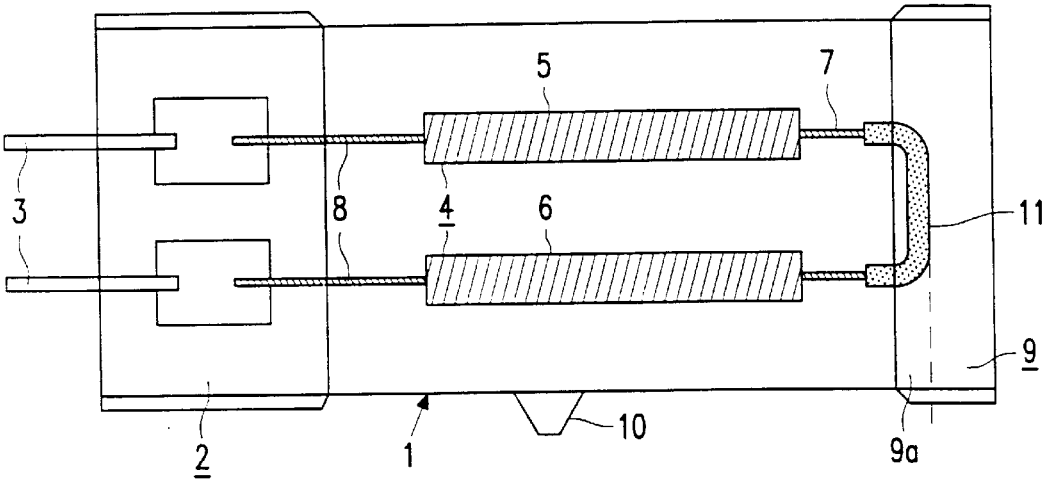
FIG. 2 shows another embodiment in side elevation.

In FIGS. 1 and 2 corresponding parts have the same reference numeral. The electric incandescent lamps shown have a tubular sealed glass envelope 1 having a first pinch seal 2 through which current conductors 3 extend to the outside. In these Figures the envelope is of quartz glass and the current conductors consist of molybdenum foils to which molybdenum pins have been welded. Despite the large difference in thermal expansion between quartz glass and molybdenum, the pinch seals are vacuum tight in the area of the foils due to the foil shape and the ductility of molybdenum.

A tungsten filament 4 having a first 5 and a second coiled portion 6 is accommodated within the envelopes. Said first and second portions are arranged one laterally of the other and are interconnected by an intermediate non-lightemitting portion of said filament 7. The filament portions are coiled coils. In these Figures, the intermediate conductors are integral with these portions and are single coils.

The filaments 4 have end conductors 8 which are connected to the current conductors 3. In the drawing they are single coils, integral with the filament portions 5,6. In the pinch seal 2 they envelope a piece of tungsten wire.

The filament 4 are supported in the envelope 1 by a portion of the envelope 1 touching and keeping fixed the intermediate conductor 7. The envelopes are filled with an inert gas and a bromine compound, e.g. hydrogen bromide. After the gas filling had been introduced, the envelopes were sealed by tipping off an exhaust tube at 10.

The envelopes 1 have a second pinch seal 9 opposite to the pinch seal 2 through which the current conductors 3 extend, in an inner longitudinal portion 9*a* of which second pinch seal 9 the intermediate conductor 7 are embedded and are thereby kept fixed.

The inner longitudinal portions 9*a* of the second pinch seal 9 are not vacuum tight, due to the fact that tungsten has much higher a coefficient of thermal expansion than quartz glass has. A capillary duct is thereby present around the intermediate conductors. The vacuum tightness of the envelopes is therefore achieved by the remaining, outer portions of the pinches.

During operation, the intermediate conductor 7 of the schematically represented filament 4 of FIG. 1, which consumes at 220 V a power of 60 W, raises the temperature of the second pinch seal 9, independent of the position of the lamp, to a –value well below 900° C., only.

The lamp of FIG. 2, which consumes a power of 300 W, has a shunt 11 as means to lower the temperature of the intermediate conductor 7 during operation. In FIG. 2 the embedded portion of the intermediate conductor is enveloped with a sleeve of 50 $\mu$m thick tungsten foil. In an attractive variation the intermediate conductor was filled with tungsten by fusing a tungsten wire by means of a laser and depositing some droplets, which were sucked into the conductor. In this variation, the diameter of the intermediate conductor was not locally increased, however.

The lamp may be mounted in a cap, if desired.

Figure 3:
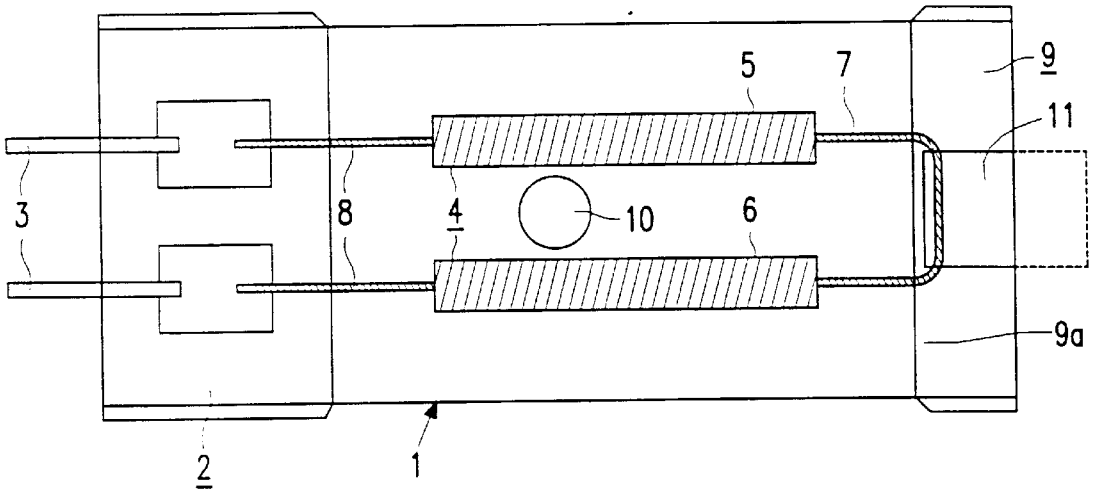
FIG. 3 shows a further embodiment in side elevation.
Figure 4:
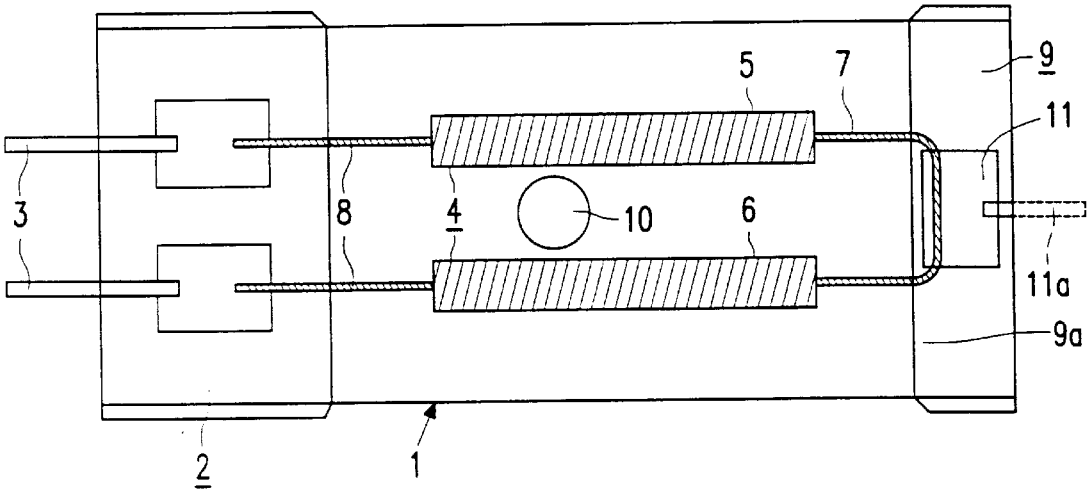
FIG. 4 shows a variation of FIG. 3.

In FIGS. 3 and 4 parts corresponding to parts in FIGS. 1 and 2 have the same reference numerals. In FIGS. 3 and 4 the major portion of the intermediate conductor 7, is overlapped by a metal foil 11, in the Figures of molybdenum. In FIG. 4*a* molybdenum wire 11*a* is welded to said foil 11. The portions of the foil 11 and the wire 11*a* respectively, which extend from the second seal 9 are cut off. The foil 11, resp. the wire 11*a*, extends to the outer surface 9*a* of the seal.

I claim:

1. An electric incandescent lamp comprising:

a tubular sealed glass envelope having first a pinch seal through which current conductors extend to the outside;

a tungsten filament having a first coiled portion and a second coiled portion accommodated within the envelope, said first and second portions being arranged one laterally of the other and being interconnected by an intermediate non-lightemitting portion of said filament, the filament having end conductors which are connected to said current conductors, wherein the envelope has a second pinch seal opposite to the first pinch seal, in an inner longitudinal portion of which second pinch seal the intermediate portion is embedded to be kept fixed.

2. An electric incandescent lamp as claimed in claim 1, wherein the lamp has means to lower the heat dissipation by the intermediate portion.

3. An electric incandescent lamp as claimed in claim 2, wherein said means comprise a sleeve of refractory metal which is wrapped around the intermediate portion.

4. An electric incandescent lamp as claimed in claim 3, wherein the sleeve is a metal foil.

5. An electric incandescent lamp as claimed in claim 3, wherein the sleeve is a metal wire.

6. An electric incandescent lamp as claimed in claim 2, wherein the intermediate portion is coiled and said means comprise a refractory metal deposited in a liquid state into the intermediate portion.

7. An electric incandescent lamp as claimed in claim 2, wherein said means comprise a metal foil welded to the intermediate portion and embedded in the second pinch seal.

8. An electric incandescent lamp as claimed in claim 7, wherein said metal foil extends to an outer surface of the second pinch seal.

9. An electric incandescent lamp as claimed in claim 7 wherein a metal wire is welded to said metal foil, said metal wire extending up to another surface of the second pinch seal.

* * * * *